United States Patent [19]

Palakanis

[11] 4,172,593

[45] Oct. 30, 1979

[54] ROLLER SKATING RINK

[76] Inventor: Ronald J. Palakanis, 464 Courtland Ave., Bridgeport, Conn. 06605

[21] Appl. No.: 831,091

[22] Filed: Sep. 6, 1977

[51] Int. Cl.[2] ..... A63C 19/10

[52] U.S. Cl. ..... 272/3

[58] Field of Search ..... 272/3, 4, 5, 2, 70; 104/1 B, 62, 63, 64, 67, 69, 70, 73, 134, 135, 136; 46/1 K, 202; 273/86 R; 404/1

[56] References Cited

U.S. PATENT DOCUMENTS

| | | | |
|---|---|---|---|
| 483,600 | 10/1892 | Butler | 272/5 |
| 809,588 | 1/1906 | Thomas et al. | 272/4 |
| 1,173,505 | 2/1916 | Hale | 404/1 |
| 1,745,241 | 1/1930 | Bartlett | 104/69 X |
| 3,238,854 | 3/1966 | Okubo | 404/1 |

FOREIGN PATENT DOCUMENTS

| | | | |
|---|---|---|---|
| 877124 | 5/1953 | Fed. Rep. of Germany | 272/4 |
| 608055 | 4/1926 | France | 104/63 |
| 427166 | 11/1947 | Italy | 104/63 |

*Primary Examiner*—Richard C. Pinkham
*Assistant Examiner*—Arnold W. Kramer
*Attorney, Agent, or Firm*—McCormick, Paulding & Huber

[57] ABSTRACT

An indoor roller skating rink having a figure 8 shape track supported on a foundation and including a pair of banked opposite end sections connected by a pair of intermediate sections. One of the intermediate sections is ramped, passes under the other intermediate section, and is disposed substantially below grade level. Foundation walls which form side walls of the ramped section support the other intermediate section which crosses above it.

10 Claims, 7 Drawing Figures

ROLLER SKATING RINK

BACKGROUND OF THE INVENTION

This invention relates in general to roller skating rinks and deals more particularly with improved rinks for roller skating and skateboarding.

Most roller skating rinks heretofore constructed include horizontally disposed circular or oval tracks. Such facilities afford adequate enjoyment to the average skater, but offers little or no challenge to the skater of exceptional ability. Further, such rinks are not particularly suitable for use by the skateboarding enthusiast. Skateboarders have generally had to resort to using empty swimming pools, jury-rigged ramps and hilly streets in order to enjoy their sport.

The production of improved roller skates and more sophisticated skateboards has created a demand for improved rink facilities. Nationally, there are now approximately 40 skateparks which provide a type of riding terrain favorable to skateboarding. The rapid increase in the popularity of this sport has created a need for improved, more challenging facilities.

Accordingly, it is the general aim of the present invention to provide improved skating rinks which afford controlled environments for maximum roller skating and skateboarding enjoyment under optimum safety conditions.

SUMMARY OF THE INVENTION

In accordance with the present invention, a roller skating rink comprises an endless track which has a supporting foundation and includes return sections and intermediate sections which connect the return sections. One intermediate section of the track is ramped to pass under another intermediate section and has foundation side walls which support the one intermediate section.

DETAILED DESCRIPTION OF PREFERRED EMBODIMENTS

Figure 1:
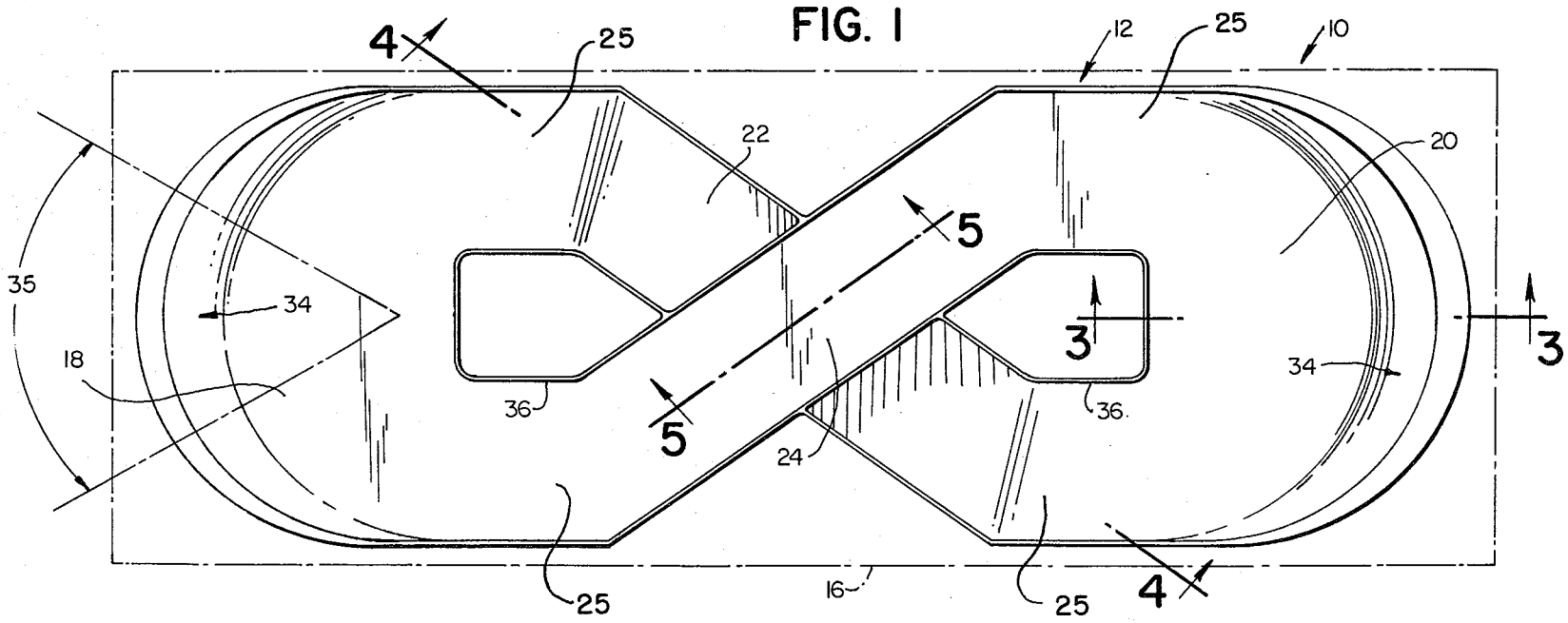
FIG. 1 is a plan view of a roller skating rink embodying the present invention.

Turning now to the drawings and referring first particularly to FIGS. 1-5, an indoor skating rink embodying the present invention is indicated generally by the reference numeral 10. The rink 10 is particularly adapted to provide a controlled environment for roller skating, skateboarding, and the like and comprises an endless track 12 which has a supporting foundation 14 and is or may be contained within a suitable building, illustrated in phantom and indicated by the numeral 16. The unique track structure is adapted to provide enjoyment for both roller skaters and skateboard enthusiasts of all skill levels and includes return track sections 18 and 20 and intermediate track sections 22, 24 and parallel transitional sections 25, 25 contiguous to and providing connection between the return sections and the intermediate sections. The intermediate track section 22 is ramped, passes under the intermediate track section 24, and is disposed substantially below grade level, the level of the grade being indicated by the letter G in FIGS. 2-4. The other intermediate section 24 is generally horizontally disposed at or near grade level and is supported above the ramp section 22 by foundation sidewalls 26, 26 associated with the ramp section and best shown in FIG. 5.

Considering now the track 12 in further detail, it has a generally FIG. 8 shape, as viewed from above and as shown in FIG. 1, and may comprise a board track supported on the foundation 14. However, in the illustrated embodiment the track 12 is defined by the upper surface of the foundation, substantially as shown. The rink size may vary, but preferably the rink is relatively large to provide sufficient skating area to facilitate establishment of a variety of traffic patterns, so that skaters of varying skills may, if desired, simultaneously skate on the track without serious risk of interference. The illustrated rink 10 may, for example, have an overall length of approximately 340 feet and an overall width of approximately 120 feet, being somewhat comparable in size to a football field. The track foundation 14, which is preferably concrete, may also form the foundation for a building, such as the building 16, which houses the track.

Figure 4:
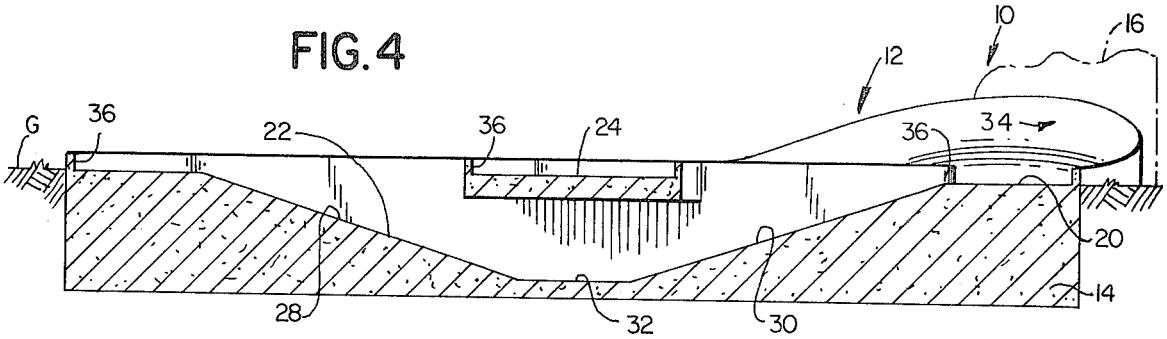
FIG. 4 is a sectional view taken along the line 4—4 of FIG. 1.
Figure 5:
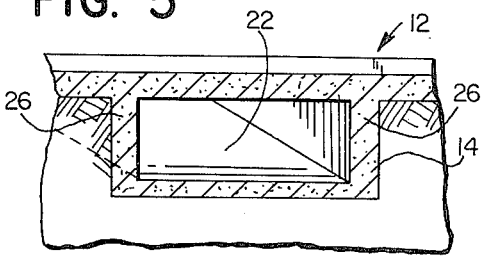
FIG. 5 is a somewhat enlarged fragmentary sectional view taken along the line 5—5 of FIG. 1.

The return sections 18 and 20 are preferably generally semi-circular track segments, as shown in FIG. 1, which are substantially horizontally disposed within a common plane and form arcuate opposite end portions of the track 12. The intermediate track section 24 preferably is a substantially straight section of the track which is generally horizontally disposed and within the plane of the return sections 18 and 20, the latter sections of the track being at or near grade level, substantially as shown. The ramped track section 22 is also substantially straight, as viewed from above, and includes a first ramped portion 30, downwardly inclined at an angle of approximately 15 degrees to the horizontal and in a direction generally toward the intermediate part 24, and a second ramped portion 28, upwardly inclined at an angle of approximately 15 degrees and, in a direction generally away from the intermediate section 24, substantially as shown in FIG. 4. A third or intermediate portion 32 of the track section 22 is located between the track portions 28 and 30 and is contiguous to the latter portions. The section 22 crosses below and centrally of the section 24, as best shown in FIG. 1. Foundation sidewalls 26, 26 extend upwardly at opposite sides of the track section 22 and support an associated portion of the track section 24 above the track section 22.

Figure 3:
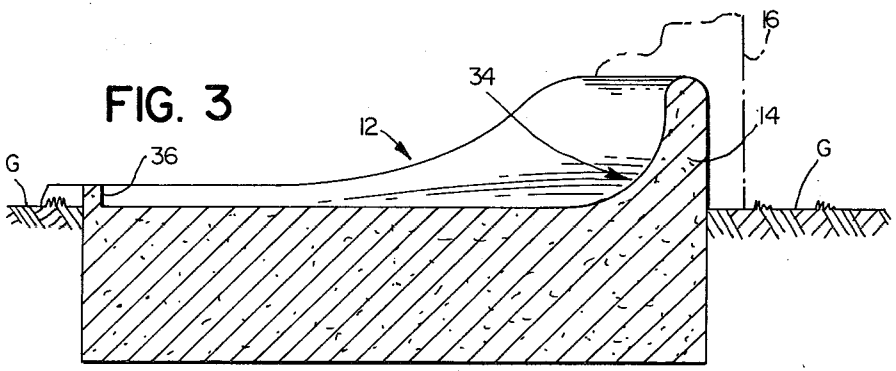
FIG. 3 is a somewhat enlarged fragmentary sectional view taken along the line 3—3 of FIG. 1.
Figure 2:
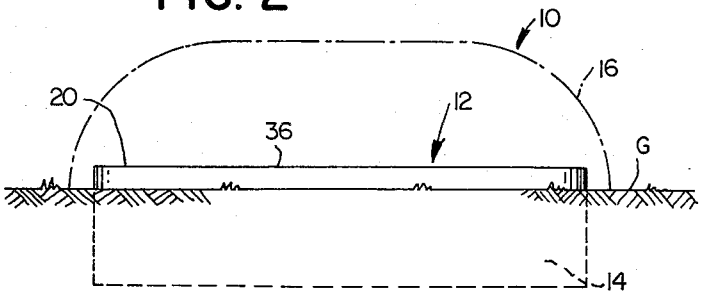
FIG. 2 is an end view of the rink of FIG. 1 shown relative to grade level.

Preferably at least one return section of the track has a banked peripheral marginal portion. However, in the illustrated embodiment 10, the return sections 18 and 20 are substantially identical and each return section has a semi-circular surface area and a banked peripheral marginal portion indicated generally at 34. Referring particularly to FIG. 3, the banked marginal portion 34, as viewed in longitudinal vertical section, has an upwardly curving parti-circular vertical cross sectional configuration which is tangent to the plane of the semi-circular suface area along its outer periphery. The banked marginal portion 34 curves radially outwardly and upwardly from a point of tangency with a horizontal plane to a point of tangency with a vertical plane, as shown in FIG. 3. In accordance with the presently preferred rink construction the banked marginal portion 34 raises to a maximum height of approximately 18 feet above the horizontally disposed portion of its associated return section. As viewed from above in FIG. 1, the banked marginal portion 34 attains its full height throughout a 60 degree central angle indicated by the numeral 35 in FIG. 1. At the outer ends of the sector 35 the foundation wall which defines the marginal portion 34 curves downwardly to join a relatively low coping or curbing which forms a boundary around the horizontally disposed portions of the track located at or near grade G.

Further, and in accordance with the presently preferred track construction the generally semi-circular track segments 18 and 20 each have a radius of approximately 90 feet. The substantially straight intermediate section 24 has a width of approximately 40 feet. Thus, the end sections 18 and 20 and the intermediate section 24 provide ample skating area for the skater of average ability who may wish to avoid the ramped section 22. However, the ramped section 22 enables the roller skater or skateboarder of extraordinary skill to attain relatively great speed so that he may climb to maximum height on the banked turning wall 34 associated with a return portion of the track 12. The illustrated construction, wherein the ramped section of the track is located generally below grade level and the remaining track sections are located at or near grade level, facilitates economical construction of relatively large tracks, since track foundation requirements will be minimal.

Figure 6:
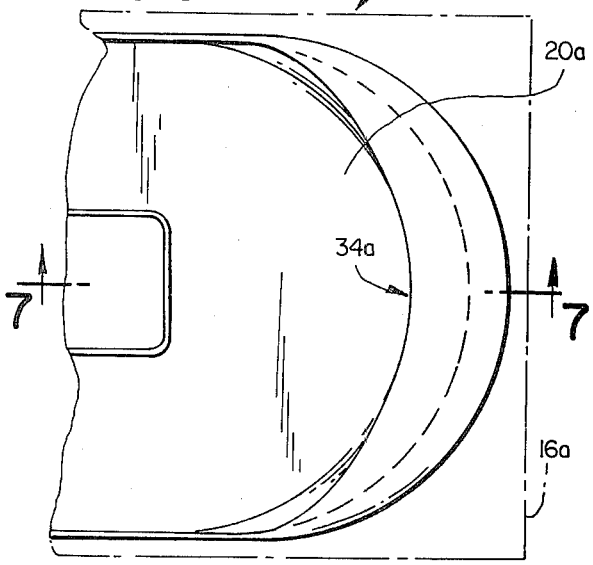
FIG. 6 is a fragmentary plan view of another roller skating rink embodying the invention.
Figure 7:
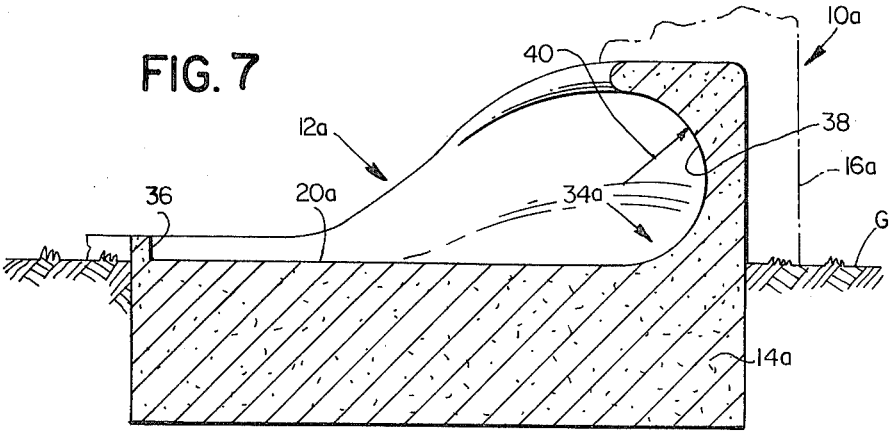
FIG. 7 is a somewhat enlarged fragmentary sectional view taken along the line 7—7 of FIG. 6

Referring now to FIGS. 6 and 7, another skating rink embodying the present invention is indicated generally at 10*a*. The rink 10*a* differs from the rink 10 previously described only in the construction and arrangement of its return sections, therefore, the remaining parts of the rink will not be hereinafter discussed. More specifically, the rink 10*a* has at least one return section, such as the section 20*a*, which has a banked peripheral marginal portion 34*a*. The banked marginal portion 34*a*, as viewed in longitudinal vertical section in FIG. 7 has an upwardly curving generally semi-circular vertical cross sectional configuration and includes an arcuately upwardly and outwardly curving first part 36 and a second part 38 which is contiguous to the first part and curves arcuately upwardly and inwardly from the first part 36. In accordance with the presently preferred construction, the banked portion 34*a* has a 15 foot radius of curvature as indicated by the numeral 40 in FIG. 7.

A skillful skater or skateboarder utilizing the ramped portion of the track may acquire sufficient centrifugal force to execute a banked turn on the upper or inwardly curved portion 38. While the rinks hereinbefore described are adapted to provide optimum safety conditions, it is contemplated that skillful skaters utilizing these facilities will wear normally required protective equipment including a helmet, knee pads, elbow pads and gloves.

I claim:

1. A roller rink comprising a continuous generally figure 8-shaped track having a supporting foundation extending below grade level and including a pair of opposite return end sections each defining a semi-circular surface area, the semi-circular surface areas of said return end sections being disposed in a common horizontal plane, at least one of said return end sections having a generally semi-circular banked outer peripheral surface portion contiguous to the associated semi-circular surface area of said one return end section, said outer peripheral surface portion having a generally particircular vertical cross sectional configuration, said outer peripheral surface portion being tangent to said common plane along the arcuate outer periphery of said associated semi-circular surface area, and curving radially outwardly and upwardly from said associated semi-circular surface area, said track having a pair of straight intermediate sections connecting said return end sections, one of said intermediate sections having its surface disposed generally within said common horizontal plane, the other intermediate section being disposed at least partially below grade level and passing under and crossing centrally of said one intermediate section, said other intermediate section having a first ramp surface downwardly inclined in a direction generally toward said one intermediate section and a second ramp surface upwardly inclined in a direction away from said one intermediate section.

2. A roller rink as set forth in claim 1 wherein said other intermediate section has a generally horizontally disposed third surface disposed between and contiguous to said first and said second ramp surfaces.

3. A roller rink as set forth in claim 2 wherein said third surface is disposed vertically below said one intermediate section.

4. A roller rink as set forth in claim 1 wherein said vertical cross sectional configuration is generally semi-circular.

5. A roller rink as set forth in claim 1 wherein said end sections and said one straight section are disposed below grade level.

6. A roller rink as set forth in claim 1 wherein said end sections and said one straight section are disposed above grade level.

7. A roller rink as set forth in claim 1 wherein said semi-circular banked outer peripheral surface portion has a maximum height throughout a central angle of 60 degrees as viewed from above.

8. A roller rink as set forth in claim 1 wherein said first and second ramp surfaces are inclined at angles of approximately 15 degrees to said horizontal plane.

9. A roller rink as set forth in claim 1 wherein said track includes four straight transitional portions, each of said transitional portions being disposed generally within said common horizontal plane and connecting an associated end of one of said intermediate sections to an associated one of said semi-circular surface areas.

10. A roller rink as set forth in claim 9 wherein said four straight transitional portions are generally parallel to each other.

* * * * *

UNITED STATES PATENT AND TRADEMARK OFFICE

CERTIFICATE OF CORRECTION

PATENT NO. : 4,172,593

DATED : October 30, 1979

INVENTOR(S) : RONALD J. PALAKANIS

It is certified that error appears in the above-identified patent and that said Letters Patent are hereby corrected as shown below:

Column 2, line 14, "FIG. 8" should be --figure 8--.

Column 2, line 66, "suface" should be --surface--.
Column 4, line 13, "particircular" should be --parti-circular--.

Signed and Sealed this

*Eighth* Day of *July 1980*

[SEAL]

*Attest:*

SIDNEY A. DIAMOND

*Attesting Officer*

*Commissioner of Patents and Trademarks*